United States Patent [19]

Grumbeck

[11] 4,035,633

[45] July 12, 1977

[54] LAMP SHADE AND METHOD

[75] Inventor: Victor N. Grumbeck, Bristol, Wis.

[73] Assignee: Beauti-Vue Products Corporation, Bristol, Wis.

[21] Appl. No.: 644,076

[22] Filed: Dec. 24, 1975

[51] Int. Cl.[2] ..... F21V 1/00

[52] U.S. Cl. ..... 240/108 R

[58] Field of Search ..... 240/108 R, 108 A, 108 B, 240/108 C, 108 D, 108 BA, 109, 110

[56] References Cited

U.S. PATENT DOCUMENTS

| | | | |
|---|---|---|---|
| 1,437,259 | 11/1922 | Mohr | 240/108 B |
| 1,538,152 | 5/1925 | York | 240/108 R |
| 1,745,365 | 2/1930 | Feiler | 240/108 R |
| 1,943,928 | 1/1934 | Pierce | 240/108 R |
| 2,637,805 | 5/1953 | Jacobs | 240/108 D |
| 3,582,643 | 6/1971 | Heise | 240/108 A |

FOREIGN PATENT DOCUMENTS

| | | | |
|---|---|---|---|
| 334,613 | 4/1919 | Germany | 240/108 B |

*Primary Examiner*—Monroe H. Hayes

*Attorney, Agent, or Firm*—Hill, Gross, Simpson, Van Santen, Steadman, Chiara & Simpson

[57] ABSTRACT

A tubular body lamp shade comprises generally vertically extending slats, and generally horizontally extending and vertically spaced strands connecting the slats into the tubular body form. Woven wood slat material may be used in making the lamp shade. The strands may be elastic yarn, thereby permitting the shade to be stretched from a generally cylindrical shape to conform to a generally frustoconical lamp shade frame onto which the lamp shade may be mounted as a slipcover.

11 Claims, 6 Drawing Figures

Fig. 1
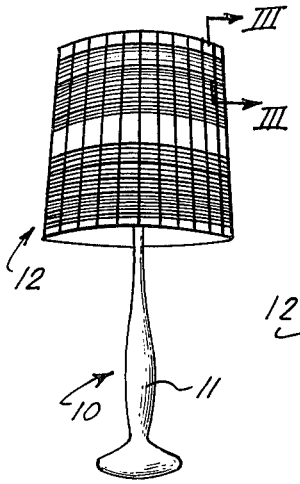
Fig. 2
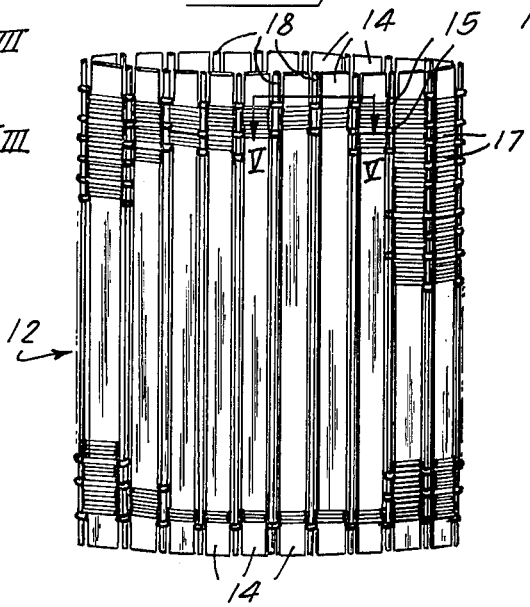
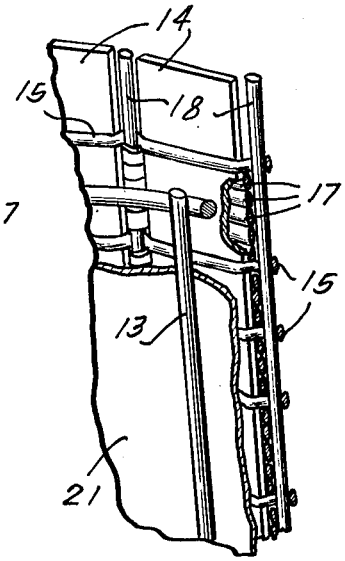
Fig. 3
Fig. 4
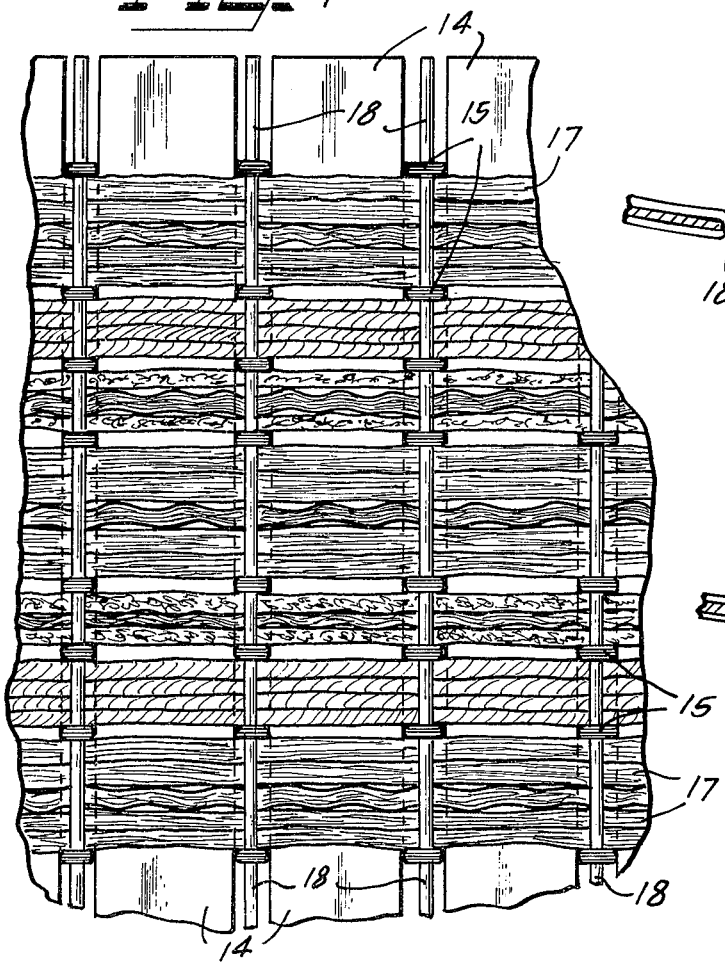
Fig. 5
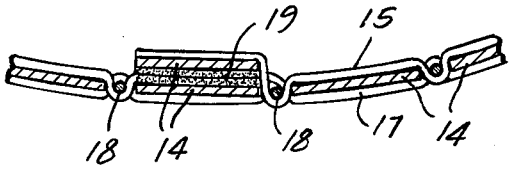
Fig. 6
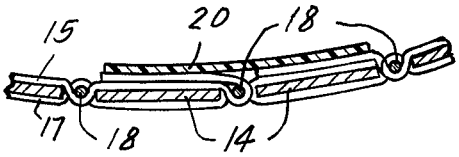

LAMP SHADE AND METHOD

This invention relates to lamp shades, and is more particularly concerned with shades especially suitable for table or floor lamps.

Table or floor lamps generally have shades equipped with frames of conic frustum form covered with any of a variety of materials such as paper, fabric, plastic, parchment, fiber glass, metal and the like. Where the shade material has deteriorated, or where for reasons of decorative harmony with other furnishings in a room, change in a lamp shade is desirable, it has heretofore been the practice either to replace the shade, including its frame, entirely or to recover the frame. However it would be more convenient and simple to renovate or redecorate lamps by applying lamp shade slipcovers.

Window drapes, curtains and the like are desirably made from woven slat material which is possessed of excellent decorative appeal in a wide range of color combination possibilities. Matching lamp shades would greatly enhance decorative harmony in any room equipped with curtains or drapes of that type.

It is accordingly, an important object of the present invention to provide a new and improved lamp shade which may be made from strand-connected slat material.

Another object of the invention is to provide a new and improved lamp shade slipcover.

A further object of the invention is to provide a new and improved method of making lamp shades.

According to features of the invention a tubular body lamp shade is provided with generally vertically extending slats connected together by generally horizontally extending and vertically spaced strands. By having the strands generally elastic such as yarn, stretching of the tubular lamp shade body as a slipcover onto an existing lamp shade frame may be readily effected. Decorative harmony in room furnishings may be attained by coordinating the lamp shades with drapes, curtains, and the like. The lamp shades may be made from woven slat material matching curtains or drapes or wall hangings of the same material.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which:

FIG. 1 is a perspective view of a lamp carrying a shade embodying feature of the invention.

FIG. 2 is an enlarged elevational view of the lamp shade before mounting on a lamp shade frame.

FIG. 3 is an enlarged fragmentary sectional elevational detail view taken substantial along the line III—III of FIG. 1.

FIG. 4 is an enlarged fragmentary elevational detail view of woven slat material from which the shade of FIG. 1 and 2 is made.

FIG. 5 is a fragmentary enlarged sectional detail view taken substantially along the line V—V of FIG. 2; and FIG. 6 is a view similar to FIG. 5 but showing a modification.

On reference to FIG. 1, a lamp 10 is shown which may be a table lamp or floor lamp having a stand 11 supporting a lamp shade 12 on a frame 13 (FIG. 3) of any preferred construction and depicted as of the conventional wire form construction in the customary conic frustum form of smaller diameter at the top and flaring to a larger diameter at the bottom.

In a preferred construction, the lamp shade 12 comprises a tubular body made of generally vertically extending slats 14 connected together by means of generally horizontally extending and vertically spaced strands 15 and 17 desirably in the form of yarn possessed of the desired decorative effects. Especially advantageous material for making the lamp shade 12 is woven wood slat material of the kind which has found wide acceptance for use in drapes, curtains, decorative wall hangings and the like. In such material, the slats 14 may be wood and on the order of ⅞ inch (23 mm) width and 1/16 inch (2 mm) thickness and of any preferred length, the slats being connected by the strands 15 and 17 in the form of yarns in preferred styles of chenille, spun rayon, viscose, ratine, or other novelty yarns in pleasing mono-chromatic or poly-chromatic arrangements. In a desirable form, the yarn strands 15 of lesser number and relatively wider spaced run across the back sides of the slats 14 and are woven over outer sides of joint rods 18 located between the adjacently spaced edges of each pair of the slats 14. The yarn strands 17 are desirably disposed in groups of any desired number providing bands between the yarns 15 and run across the front or outer faces of the slats 14 and are woven around the back sides of the rods 18. This provides a structure which is thoroughly form retaining in the direction of the longitudinal axes of the slats 14, which is generally hingedly flexible at the joints provided by the yarn strands 15 and 17 and the rods 18, and because of the flexibility and elasticity of the yarns 15 and 17 permits limited resilient yielding of the yarn-connected slats laterally of the slats.

In making the lamp shade 12, a strip of the woven slat material of suitable width defined by the lengths of the slats 14, and length defined by the number of connected slats, is connected together at its free ends into tubular body form by securing the terminal slats together in any suitable manner. For example, in FIG. 5 the terminal slats 14 are assembled in lapped relation and are secured together by suitable means such as a bonding agent or adhesive layer 19, the yarn strands 15 and 17 associated with the terminal slats being anchored by the adhesive, or other adhesive especially applied hereto. If preferred, instead of lapping the terminal slats 14, they may remain coplanar as shown in FIG. 6, and a suitable joining strip 20 fixed across the joint between the terminal slats, including anchoring the terminal end portions of the strand yarns 15 and 17. In a desirable form, the joint strip 20 may comprise a flexible and elastic strip material such as a suitable plastic which may be secured adhesively or by thermal plastic bonding, or the like.

In calculating the diameter of the completed tubular body of the shade 12, the smallest diameter of the frame 13 to which the shade is to be applied is taken into account, and the original diameter of the shade body formed to the outside diameter of the smallest diameter of the frame. Then, in mounting the shade 12 on the frame 13, the lower end of the tubular shade body is applied to the upper smallest diameter end of the frame 13, and the shade 12 pressed downwardly onto and about the frame 13, resiliency of the connecting strand yarns 15 and 17 permitting the shade to expand into the generally frustoconical shape of the frame 13. Although the shade 12 is adapted to be applied to a stripped lamp shade frame, the shade 12 is especially adapted to be applied as a convenient slipcover over a frame already carrying a cover or a shade 21 which it is not necessary to strip from the frame 13 before applying the shade 12. In this way, when it is desired to change the decor of a room, it is not necessary to change the existing lamp shades, but slipcover shades embodying features of the invention can be provided to be slipped onto the existing shades to fulfill decorative harmony or coordination. By reason of their resilience, stretched slat-connecting yarns 15 and 17 cause the shade 12 to grip the frame 13 to which applied firmly so that the shade 12 is self-retaining. However, if it is desired to remove the shade 12, that can be readily accomplished by forcefully sliding the shade off of the frame 13 toward the narrow end of the frame. The same lamp 10 may be supplied interchangeably with slip cover shades 12 coordinated with time-to-time variations in decor.

It will be understood that variations and modifications may be effected without departing from the spirit and scope of the novel concepts of this invention.

I claim as my invention:

1. A lamp shade adapted to be mounted on a frustoconical frame, the lamp shade comprising:
   - a tubular body of an original generally cylindrical inside diameter substantially the same as the smallest diameter of the frustoconical frame;
   - said body comprising generally vertically extending slats;
   - generally horizontally extending strands connecting the slats in the tubular body;
   - the strands being disposed successively from adjacent to the top of the tubular body to adjacent the lower end of the tubular body; and
   - said strands being horizontally elastic so that the tubular body can be applied to the frustoconical frame by axially slipping the tubular body onto the frame from the smallest diameter end of the frame all the way to the largest diameter of the frame and the tubular body can expand due to the resilience of the strands whereby to conform to the frustoconical shape of the frame and cause the slats to grip the frame and thereby retain the expanded body frictionally on the frame.

2. A lamp shade according to claim 1, wherein said slats are wooden, and said strands comprise yarn of at least limited elasticity.

3. A lamp shade according to claim 1, wherein the slats are in limited edge-to-edge spaced relation, rods between and parallel to the slat edges, and said strands being woven over said rods, certain of the strands running across back faces of the slats and others of the strands running across front faces of the slats.

4. A lamp shade according to claim 1, wherein said slats and said strands are originally connected together in a linear strip of material wherein the slats and the strands are interwoven, terminal slats at the ends of the strip of material to which ends of the strands are connected, and means securing said terminal slats together to maintain the tubular body form.

5. A lamp shade frame and a slip-over lamp shade mounted thereon, comprising, in combination;
   - a frustoconical lamp shade frame having an upper end and a lower substantially larger diameter end;
   - and a slip-on lamp shade having generally vertically extending slats at least as long as said lamp shade and generally horizontally extending elastic strands connecting the slats into tubular body form from adjacent to the upper ends of the slats to adjacent the lower ends of the slats;
   - the tubular body being of an original diameter substantially the same as the smaller diameter upper end of the frame and the body being expanded progressively to a larger diameter from the upper end to the lower end conformable to the frustoconical shape of the frame onto which the shade body has been slipped by pushing it onto the frame from the upper end of the frame toward the lower end of the frame, expansion of the body being permitted by elasticity of said strands and the elasticity of the strands reacting to hold the body frictionally in place on the frame.

6. A combination according to claim 5, wherein said frame comprises a bare frame and the lamp shade body directly engages with the bare frame.

7. A combination according to claim 5, wherein said lamp shade frame supports a covering, and said lamp shade body being supported on the frame through said covering.

8. A method of making a tubular slip-on lamp shade body and mounting the same upon a frame, comprising:
   - arranging generally vertically extending slats into an originally substantially cylindrical tubular body;
   - connecting the slats into said tubular body by means of generally horizontal elastic strands extending in rows from adjacent the upper ends to adjacent the lower ends of the slats;
   - sliding the tubular body over the upper end of a lamp shade having at least a lower end of a larger diameter than the original inside diameter of the tubular body;
   - expanding and pressing the tubular body slidably endwise onto the lamp shade and into conformity with the shape of the frame;
   - and in expanding the tubular body elastically stretching said strands.

9. A method according to claim 8, comprising sliding the lamp shade body into direct engagement with the bare frame.

10. A method according to claim 8, comprising sliding the lamp shade body into supported engagement with the frame through a covering on the frame.

11. A method according to claim 8, comprising interweaving said slats and said strands into an originally linear strip of material, and securing terminal slats of the strip together to provide the substantially cylindrical original form of the body.

* * * * *